United States Patent [19]

Falcy et al.

[11] 4,048,794

[45] Sept. 20, 1977

[54] SEALED CABLES FOR ATTACHMENT TO SUBMARINE ANCHORAGES

[75] Inventors: Bernard Charles Albert Falcy; Adrien Vaudant, both of Bourg-En-Bresse, France

[73] Assignee: Societe Anonyme des Hauts Fourneaux de la Chiers, Longwy-Bas, France

[21] Appl. No.: 684,831

[22] Filed: May 10, 1976

[30] Foreign Application Priority Data

May 27, 1975 France ..... 75.16403

[51] Int. Cl.[2] ..... H01B 1/02; H01B 7/28

[52] U.S. Cl. ..... 57/149; 174/128 R; 57/145

[58] Field of Search ..... 57/139, 144, 145, 148, 57/149, 153, 160, 162, 166; 174/23, 27, 42, 126 R, 126 CP, 128 R, 130, 131

[56] References Cited

U.S. PATENT DOCUMENTS

| | | | |
|---|---|---|---|
| 338,913 | 3/1886 | Batchelor | 57/146 |
| 1,821,908 | 9/1931 | Fowle | 174/128 R |
| 2,385,241 | 9/1945 | White | 57/145 |
| 2,778,870 | 1/1957 | Nolan | 174/128 R |
| 3,468,119 | 9/1969 | Kuratomi | 174/128 R UX |
| 3,813,481 | 5/1974 | Adams | 174/128 R X |
| 3,842,185 | 10/1974 | Raw et al. | 174/128 R X |

*Primary Examiner*—Donald Watkins
*Attorney, Agent, or Firm*—Brisebois & Kruger

[57] ABSTRACT

Sealed cable comprises a central core of wires embedded in a hydrophobic material, an intermediate layer of steel wires and an outer layer of wires made of a metal more electro-negative than the wires of the intermediate layer.

8 Claims, 1 Drawing Figure

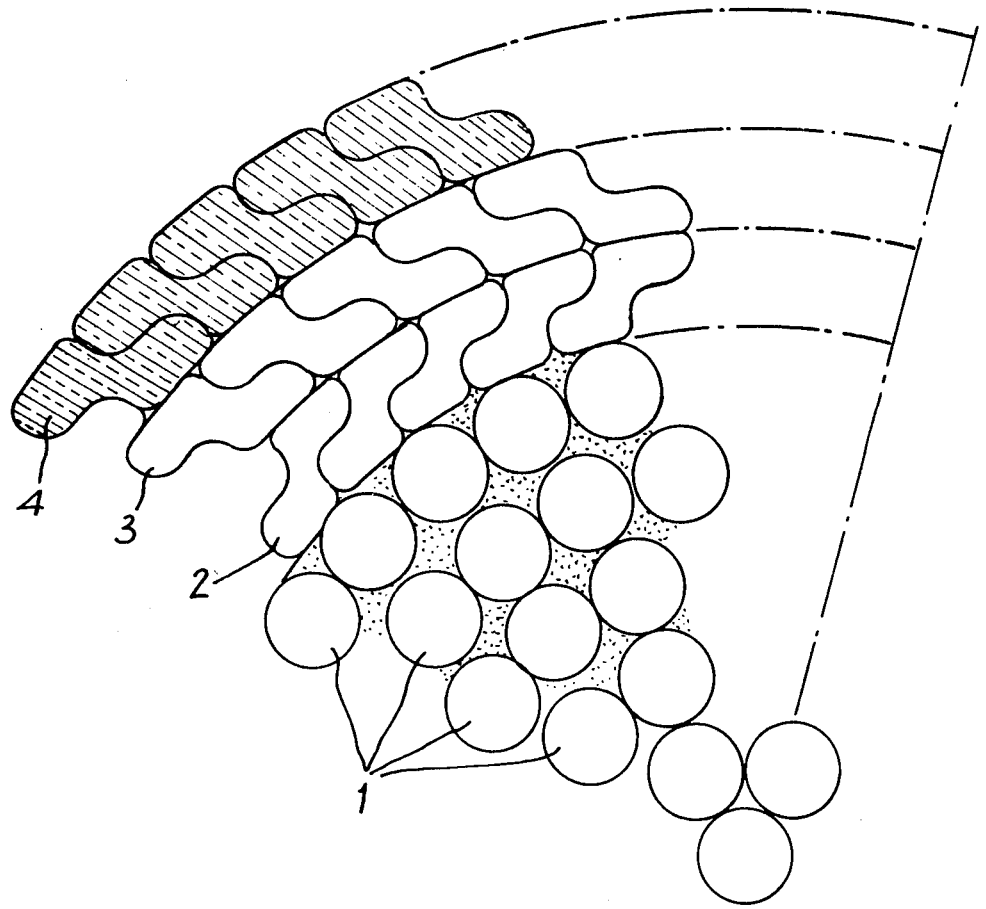
4
3
2
1

SEALED CABLES FOR ATTACHMENT TO SUBMARINE ANCHORAGES

SUMMARY OF THE INVENTION

This invention relates to a sealed cable adapted to be attached to a submarine anchorage.

The development of submarine petroleum research at greater and greater depths requires the use of improved metallic cables adapted to connect anchorage points at the bottom of the sea to floating or immersed bodies. These cables must, in use, resist substantial tensions while being exposed to substantial corrosion. These two phenomena combine their effects because the resistance of metal to fatique decreases rapidly as it corrodes.

The anchorages actually in use employ rigid structures made of concrete or steel which are generally quite expensive and difficult to put in place.

The present invention proposes to supply cables adapted to be attached to anchorages, which cables are relatively light, easy to put in place and inexpensive while offering excellent resistance to corrosion in a submarine environment and good mechanical strength so as to permit them to withstand the alternating tensions to which they are commonly subjected during use.

The object of the present invention is accordingly to provide a sealed cable especially adapted to be used as a submarine anchorage cable characterized by the fact that it comprises a central core, at least one intermediate layer of metallic wires, and a peripheral cathodic protective layer made of metallic wires of a metal which is more electro-negative than the metal of the wires of the intermediate subjacent layer.

In a preferred embodiment of the invention the peripheral layer is a wire having a Z-shaped cross-section and may be made of aluminum, one of its alloys, zinc or magnesium. The intermediate layer immediately beneath the peripheral layer, as well as any other intermediate layers, are also advantageously made of wires having a Z-shaped cross section. The intermediate subjacent layer is advantageously made of stainless steel, especially an austenitic chrome-nickel steel. It is advantageous to provide at least one other intermediate layer beneath the intermediate layer immediately beneath the peripheral layer, this inner intermediate layer being advantageously made of high strength carbon steel.

The core is preferably made of a plurality of layers of round, metallic wires, for example, of high strength carbon steel, these round, metallic wires being embedded in a hydrophobic product such, for example, as a petroleum product sold commercially as SHELL S.6604A.

The present invention is also directed to submarine anchorages comprising at least one cable which is a sealed cable according to the invention, the ends of he peripheral layer of which are mounted in sockets assuring electrical continuity, especially mechanical anchoring sockets, the electrical contact being provided by the fact that the peripheral layer of the cable is embedded at its ends in a metal which fuses at low temperature such, for example, as zinc, which is itself in contact with the anchorage socket.

In an advantageous manner the peripheral layer may be subjected to mechanical contraction at the moment that the cable is positioned on the site. This still further improves the fluid-tightness of the cable.

It will be appreciated that the peripheral layer provides, on the one hand, cathodic protection by means of a soluble anode, against the corrosion due to the sea water and, on the other hand, serves as a seal in combination with the intermediate layers in order to limit the penetration of water into the cable and prevent an escape of the hydrophobic product surrounding the round wires of the core to the outside of the cable.

A preferred embodiment of the cable according to the invention will now be described with reference to the accompanying drawing.

The single FIGURE in the drawings is a schematic radial section through a cable according to the present invention. The core of the cable comprises a plurality of layers of round wires 1 extending parallel to each other longitudinally of the cable and made of a carbon steel corresponding to the standard AFNOR steel NFA 35051, quality FM 75-3.

The core may also be formed by helically winding the wires about each other so as to constitute a strand.

In the example illustrated the wires 1 have a diameter of 7 mm and are embedded in a hydrophobic petroleum compound such as SHELL S.6604A grease.

A layer 2 of wires having a Z-shaped cross section encircles this core. The wires of this layer are made of a carbon steel meeting the standard AFNOR steel NFA 35051 with a quality of FM 75-3.

In the embodiment illustrated the layer of Z-shaped wires 2 is 7 mm thick.

Around this layer is located a layer of Z-shaped wires 3 made of a stainless steel meeting the standard AFNOR Z2 CNDU 17-16 and constituting the subjacent layer immediately beneath the peripheral protective cathodic layer 4 made of aluminum wires having a Z-shaped cross section.

In the example illustrated the peripheral aluminum layer is 8 mm thick and the subjacent layer of stainless steel is also 8 mm thick.

The cable made in this manner may have, by way of example, a diameter of 150 mm, a mass of 105 kilograms per meter, and a breaking strength of about 1,250 tons.

The wires of the cable core are perfectly cathodically protected by the peripheral layer and mechanically protected by the fluid-tightness of the peripheral layer and the subjacent layer as well as by the hydrophobic product so that its mechanical properties are not affected over the course of time by corrosion, and the cable thus made can resist tension throughout the life of the anchorage, taking into account the contemplated conditions of use.

While only a preferred embodiment of the invention has been described, it will be obvious that the scope of the invention is not limited to the details thereof and that the cable may be modified in shape or material without thereby departing from the basic principles of the invention.

What is claimed is:

1. Sealed cable for submarine anchorages which comprises a central core, at least one intermediate layer of metallic wires having a Z-shaped cross-section, and a peripheral cathodic protective layer made of metallic wires having a Z-shaped cross-section formed from a metal more electronegative than the metal of the wires of said intermediate layer.

2. Sealed cable as claimed in claim 1 comprising additional intermediate layers made of wires which also have a Z-shaped cross section.

3. Sealed cable as claimed in claim 1 in which the intermediate layer is made of stainless steel.

4. Cable as claimed in claim 3 in which the intermediate layer is made of an austenitic chrome-nickel steel.

5. Cable as claimed in claim 1 in which the peripheral layer is made of a metal selected from the group consisting of aluminum and its alloys, zinc and magnesium.

6. Sealed cable as claimed in claim 1 comprising a plurality of intermediate layers in which at least one of the intermediate layers other than the layer immediately inside the peripheral layer is made of a high strength carbon steel.

7. Sealed cable as claimed in claim 1 in which the core is made of a plurality of layers of round wires embedded in a hydrophobic product.

8. Sealed cable as claimed in claim 7 in which the round wires are made of a high strength carbon steel.

* * * * *